US006234436B1

(12) United States Patent
Kump

(10) Patent No.: US 6,234,436 B1
(45) **Date of Patent: *May 22, 2001**

(54) HEAVY DUTY DISPLAY HOOK

(75) Inventor: Daniel J. Kump, Mentor, OH (US)

(73) Assignee: Fasteners For Retail, Inc., Cleveland, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/191,844

(22) Filed: Nov. 13, 1998

Related U.S. Application Data

(60) Division of application No. 08/838,442, filed on Apr. 7, 1997, and a continuation-in-part of application No. 08/376,110, filed on Jan. 20, 1995, now Pat. No. 5,647,566.

(51) Int. Cl.[7] ..... A47B 96/06

(52) U.S. Cl. ..... 248/220.21; 248/220.31; 248/220.41; 211/59.1

(58) Field of Search ..... 248/220.21, 220.31, 248/220.41, 220.42, 225.21, 235, 239, 304; 211/57.1, 59.1, 57.9

(56) References Cited

U.S. PATENT DOCUMENTS

| | | | |
|---|---|---|---|
| D. 300,003 | 2/1989 | Hutchison | D8/367 |
| 2,498,842 | 2/1950 | Kuenne | 219/536 |
| 2,927,956 | 3/1960 | Reisch | 174/138 J |
| 3,252,678 | 5/1966 | Myers et al. | 248/220.31 |
| 3,273,844 | 9/1966 | Hodson et al. | 248/216.1 |
| 3,409,260 * | 11/1968 | Bleed | 248/220.31 |
| 3,516,552 | 6/1970 | Salava | 211/106.01 |
| 3,628,762 | 12/1971 | Williams | 248/235 |
| 3,848,843 | 11/1974 | Levy | 248/224.51 |

(List continued on next page.)

FOREIGN PATENT DOCUMENTS

| | | |
|---|---|---|
| 1112265 | 8/1961 | (DE) . |
| 1200778 | 12/1959 | (FR) . |

OTHER PUBLICATIONS

Fasteners For Retail 1996 Buyers Guide, cover page and pp. 57, 58, 59 (Jan. 9, 1996).

Fasteners For Retail 1997 Buyers Guide entitled "Our Experience Is On Display" (cover page and pp. 54 and 55).

*Primary Examiner*—Anita M. King
(74) *Attorney, Agent, or Firm*—Fay, Sharpe, Fagan, Minnich & McKee, LLP

(57) ABSTRACT

A heavy duty display hook which supports point of purchase items or packages is insertable into a rectangular aperture of a panel, such as a cardboard panel provided with a number of spaced apertures for display hooks. The display hook includes a front plate which is substantially vertically disposed in use and which has an upper end and a lower end and an elongated support member which projects forwardly from and extends upwardly in slightly inclined fashion to the front plate. A pair of arms extend rearwardly from the front plate. A slot is disposed between the pair of arms. The arms have a first section which extends through the slot in the panel. A second section of the arms extends upwardly from the first section. The second sections are spaced from and are generally parallel to the front plate. A wing may extend away from each of the second sections.

14 Claims, 6 Drawing Sheets

U.S. PATENT DOCUMENTS

| | | | | |
|---|---|---|---|---|
| 3,954,243 | | 5/1976 | Sharp et al. | 248/235 |
| 4,026,508 | * | 5/1977 | Ziegler | 248/220.31 |
| 4,441,619 | | 4/1984 | Gibitz | 211/70.6 |
| 4,502,602 | * | 3/1985 | Swanson | 211/59.1 |
| 4,671,417 | | 6/1987 | O'Brien | 211/59.1 |
| 4,750,698 | * | 6/1988 | Barnes | 248/220.41 |
| 4,762,299 | * | 8/1988 | Langelier | 248/220.41 |
| 4,801,116 | * | 1/1989 | Blankenship | 248/220.41 |
| 4,850,557 | * | 7/1989 | Valiulis | 248/220.41 |
| 4,860,905 | | 8/1989 | Schott et al. | 211/59.1 |
| 5,035,388 | * | 7/1991 | Nagel | 248/220.41 |
| 5,109,993 | | 5/1992 | Hutchison | 211/87.01 |
| 5,154,304 | | 10/1992 | McAuley | 211/59.1 |
| 5,163,567 | | 11/1992 | Betts, Sr. | 211/75 |
| 5,379,976 | | 1/1995 | DeGirolamo | 248/220.43 |
| 5,595,309 | * | 1/1997 | Bauer et al. | 211/59.1 |
| 5,647,566 | * | 7/1997 | Kump | 248/220.21 |

* cited by examiner

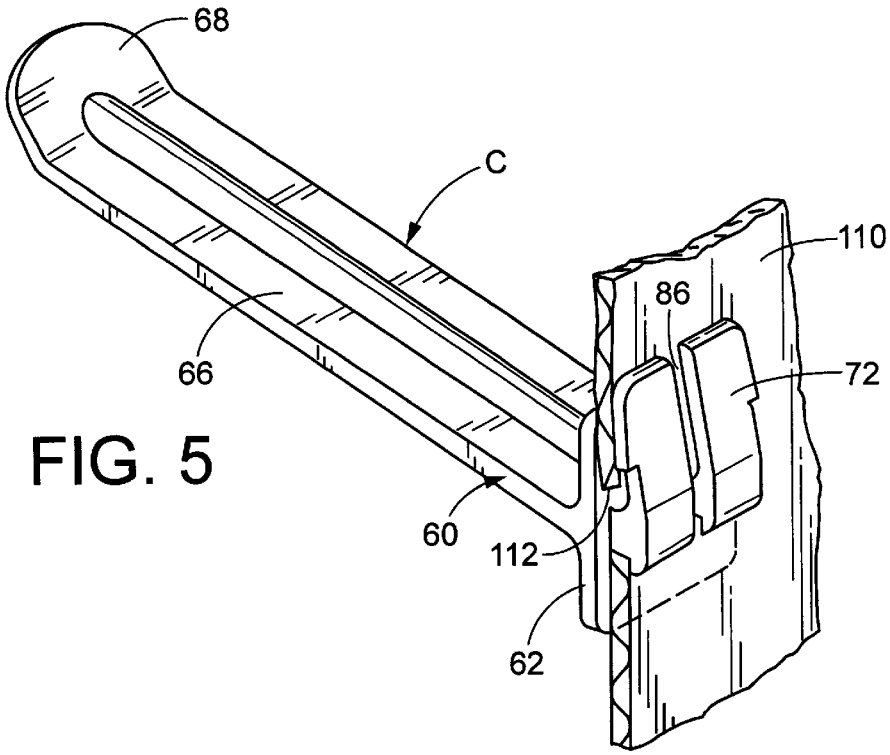
FIG. 5
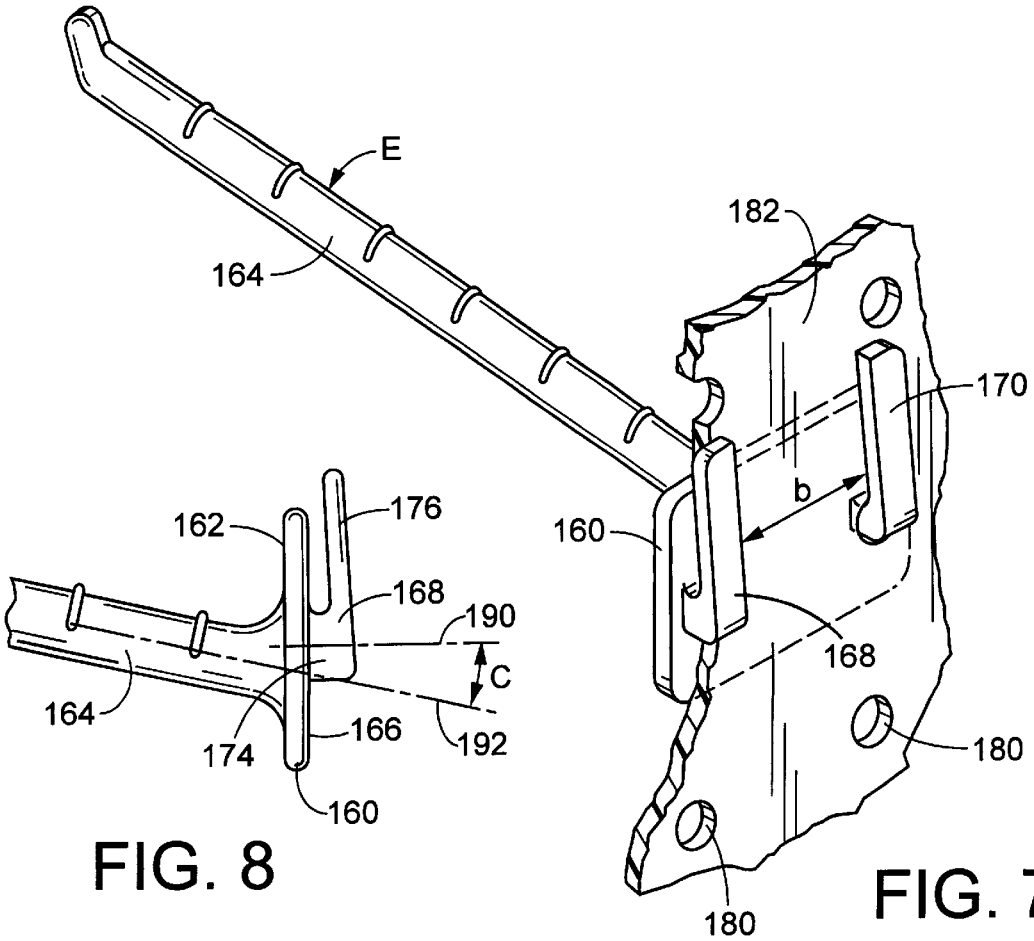
FIG. 8
FIG. 7

HEAVY DUTY DISPLAY HOOK

This application is a division of U.S. patent application Ser. No. 08/838,442 filed on Apr. 7, 1997 and still pending. That application, in turn, is a continuation-in-part of application Ser. No. 08/376,110 filed on Jan. 20, 1995 which issued into U.S. Pat. No. 5,647,566 dated Jul. 15, 1997.

BACKGROUND OF THE INVENTION

This invention relates generally to a display hook for point of purchase items or packages. More particularly, the present invention relates to a heavy duty display hook for insertion into a slot of a panel or into the holes of a pegboard.

The retail sales industry is now widely employing point of purchase display systems which include a fold-up display rack and product display hooks which can be prepacked with the product before shipment to the point of purchase merchant for final assembly. In such a display system, a display stand or rack is constructed of a lightweight inexpensive material, such as cardboard, which may be folded up into a rigid folded planar structure containing attractive artwork or consumer information related to the product. In order to provide a fully stocked display system which is ready for presentation to the customer, manufacturers now provide a prepacked display in which the product has already been stocked or installed on the several display hooks mounted on the partially assembled panel. In this way, upon receipt of the manufacturer's shipping container, the merchant or retailer need only assemble the stand components to achieve a fully stocked display system which is ready for presentation to the customer.

Several known forms of such display systems employ a hook mounted in a horizontal or vertical slot in a panel, such as cardboard. One particularly advantageous form of such a system is illustrated in U.S. Pat. No. 4,860,905 which is owned by the assignee of the instant invention. That patent is hereby incorporated by reference in its entirety. While the display hook disclosed in the '905 patent is advantageous, it has been found that the holding power of the hook employed in that display system is only on the order of 3 or 4 lbs. If the weight of packages on the hook is greater than that amount, the hook tends to break at the joint between the bridge and the back plate thereof.

Other such product display systems with hooks are also widely known. Another example of such a display system is illustrated in U.S. Pat. No. 4,671,417. However, the hook disclosed in this patent is similarly able to hold only 3 or 4 lbs. of merchandise before breaking.

Accordingly, it has been considered desirable to develop a new and improved display hook which would overcome the foregoing difficulties and others while providing better and more advantageous overall results.

BRIEF SUMMARY OF THE INVENTION

According to the present invention, a new and improved display hook is disclosed, the hook being adapted for insertion into at least one aperture of a panel.

More particularly in accordance with this aspect of the invention, the display hook comprises a front plate which is substantially vertically disposed in use, which has an upper end and a lower end and an elongated support member which projects forwardly from and extends upwardly in slightly inclined fashion to the front plate, the support member having a longitudinal axis. At least one arm extends rearwardly from the plate. The at least one arm includes a first section having a longitudinal axis which is located above the longitudinal axis of the support member. The first section is adapted to extend through the panel aperture. A second section extends upwardly from the first section. The second section is spaced from and is generally parallel to the front plate.

Preferably, a pair of arms are provided and a slot is located between them to separate the pair of arms. If desired, the second section of each of the pair of arms is at least as thick as the front plate. The width of the pair of arms and the slot between them is slightly less than the width of the at least one aperture to prevent movement of the hook in the at least one aperture. Preferably, the pair of arms are longitudinally spaced from each other. If desired, the hook can further comprise a flange extending away from a lower edge of the first section of the at least one arm, the flange preventing the hook from falling out of the at least one aperture. Preferably, the front plate, the support and the at least one arm are of one piece and are made of a plastic material. If desired, the hook can further comprise a wing extending from the second section of the at least one arm in a direction approximately parallel to the front plate. The wing prevents the hook from falling out of the at least one aperture.

In accordance with another aspect of the present invention, a display hook is provided for insertion into a rectangular aperture of a panel.

More particularly in accordance with this aspect of the invention, the display hook comprises a front plate which is substantially vertically disposed in use and which has an upper end and a lower end. A forwardly projecting support member extends upwardly in slightly inclined fashion from the front plate. A support section extends rearwardly from the plate and through the aperture. A pair of arms extends upwardly from the support section. The arms are generally parallel to the front plate and are spaced therefrom. A wing extends away from at least one of the arms.

A slot is preferably located between the pair of arms wherein the width of the wings, the second sections and the slot is larger than a width of the aperture. In this manner, the wing prevents the hook from becoming detached from the panel.

One advantage of the present invention is the provision of a new and improved display hook with an increased weight bearing capacity which is capable of supporting up to 9 or 10 lbs. of merchandise without breaking.

Another advantage of the present invention is the provision of a point of purchase product display system utilizing an outwardly projecting display hook which can be preassembled to a fold-up display stand and prepacked with product for shipment to and assembly by the point of purchase merchant.

Still another advantage of the present invention is the provision of a display hook which is able to withstand the omnidirectional forces imparted to the hook during packing, shipping and assembly of the display system in which it is held without being pulled out of the display stand regardless of the attitude of the stand.

Yet another advantage of the present invention is the provision of a display hook having a front plate with a forwardly extending elongated support member that has a longitudinal axis and a bridge extending rearwardly from the front plate wherein a longitudinal axis of the bridge is located above the longitudinal axis of the support member in order to strengthen the hook.

A further advantage of the present invention is the provision of a display hook having a front plate, a bridge, adapted to extend through a slot in a display panel, and a rear plate wherein the rear plate is at least as thick as the front plate in order to strengthen the hook.

A still further advantage of the present invention is the provision of a display hook in which an upper edge of the rear plate is located near an upper edge of a front plate. This relationship stiffens the hook and makes it more able to bear larger loads on a support member thereof.

A yet further advantage of the present invention is the provision of a display hook having a pair of spaced L-shaped rear legs by which the hook can be attached to a support surface such as an apertured panel or a pegboard.

An additional advantage of the present invention is the provision of a display hook with a pair of legs which are so spaced apart that they can be accommodated either in a single slot of a cardboard panel or in a pair of spaced holes in a pegboard.

Still yet another advantage of the present invention is the provision of a display hook with a pair of spaced legs which each have an outwardly facing wing. The wings of the legs extend past the side edges of the slot through which the legs extend. The legs need to be flexed towards each other so as to allow the wings to clear the side edges of the slot.

It is yet another advantage of the present invention to provide a display hook which can be inexpensively fabricated, since it includes a supporting means employing less material than the known support hooks, but still achieves a high strength to weight ratio.

Still other benefits and advantages of the present invention will become apparent to those skilled in the art upon a reading and understanding of the following detailed specification.

BRIEF DESCRIPTION OF THE DRAWINGS

The invention may take form in certain components and parts preferred embodiments of which will be described in detail in this specification and illustrated in the accompanying drawings wherein:

FIG. 5 is a perspective view of the product display hook of FIG. 4A as employed with a panel;

FIG. 7 is a perspective view of a product display hook according to a third embodiment of the present invention as employed with a pegboard;

FIG. 8 is a side elevational view of a rear portion of the product display hook of FIG. 7;

DETAILED DESCRIPTION OF THE PREFERRED EMBODIMENTS

Figure 1:
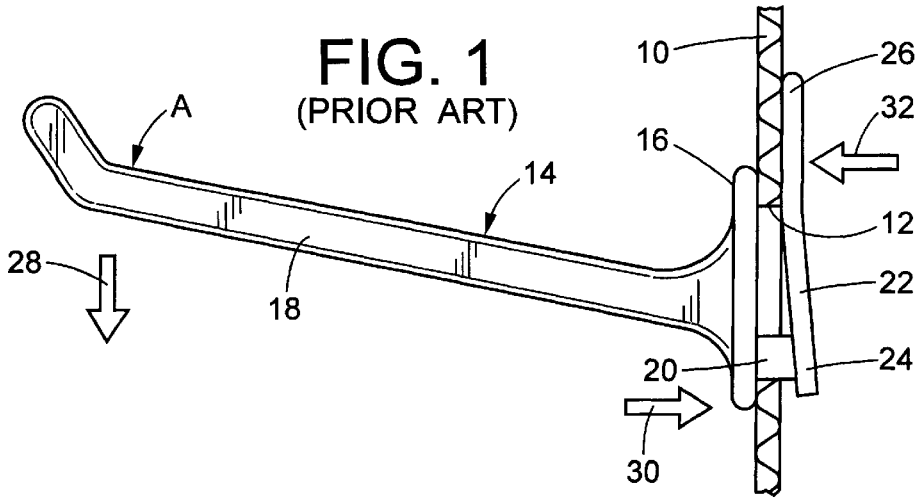
FIG. 1 (PRIOR ART)
FIG. 1 is a side elevational view partially in cross section of a first type of product display hook and panel according to the prior art.

Referring now to the drawings, wherein the showings are for purposes of illustrating the preferred embodiments of the invention and not for purposes of limiting same, FIG. 5 shows a display hook C according to a first embodiment of the present invention.

With reference first to FIG. 1, a conventionally known display includes a panel 10 which is provided with a series of rectangularly spaced vertically elongated slots or holes 12 in which are mounted display hooks A. The panel may be cardboard, corrugated cardboard or plastic, for example, and may be prepacked with the hooks assembled and the merchandise to be displayed mounted on such hooks. The merchandise can be a wide variety of items which may be hung directly from the hook, blister packed, carded or packaged. The panel may include folded side panels, a rear easel strut or other devices to support the panel and the merchandise thus displayed in an upright position.

The display hook A includes a body 14 having a front plate or face plate 16, which is generally vertically elongated and can be rectangular. The plate 16 is usually larger in size than is the configuration of the slot 12 to cover same. A forwardly projecting support member or bar 18 extends upwardly at a slight incline from the face plate and terminates in an upturned tip portion. Extending rearwardly from the face plate 16 is a narrow, short bridge 20 which is square in vertical section and connects the front plate 16 to a rear plate 22. The bridge 20 is spaced above the bottom edge of the front plate and the bottom edge of the rear plate. The rear plate is thinner than the front plate and has a first section 24 which extends upwardly from the bridge at a slight angle to the vertical plane toward the rear of the front plate. The rear plate also has a second section which lies in a plane parallel to the plane of the front plate 16 and terminates at an upper edge which is located a considerable distance above the upper edge of the front plate. The upper portion 26 forms a pressure pad for resisting the forces acting on the hook body 14.

Three forces are shown as acting on the hook body. The first of these, as illustrated by arrow 28, pulls downwardly on the bar 18. The force depicted by arrow 28 is caused by the packages suspended from the bar 18. This causes a second force illustrated by arrow 30 which pushes the bottom of the face plate 16 against the front face of the panel 10. This in turn causes the third force as illustrated by arrow 32 which pushes the upper section 26 of the back plate 22 against the rear surface of the panel 10. The weight of objects suspended from the bar 18 causes a moment tending to rotate the display hook body 14 about its area of contact with the panel 10. It has been found that this moment acts most strongly on the joint between the bridge 20 and the rear plate 22. It has also been found that this joint is prone to breakage when the weight of product supported on the bar 18 is above 3 or 4 lbs. Another problem with the display hook A was that the narrow bridge 20 may allow the hook body 14 to spin in the slot 12 if the slot is not sufficiently narrow.

Figure 2:
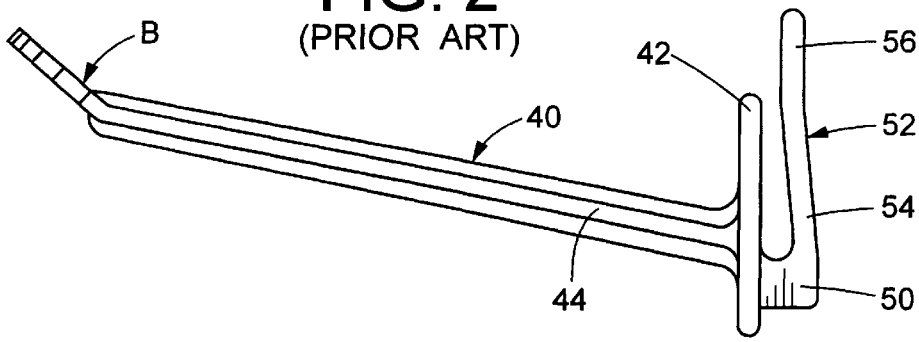
FIG. 2 (PRIOR ART)
FIG. 2 is a side elevational view of a second type of product display hook according to the prior art.
Figure 3:
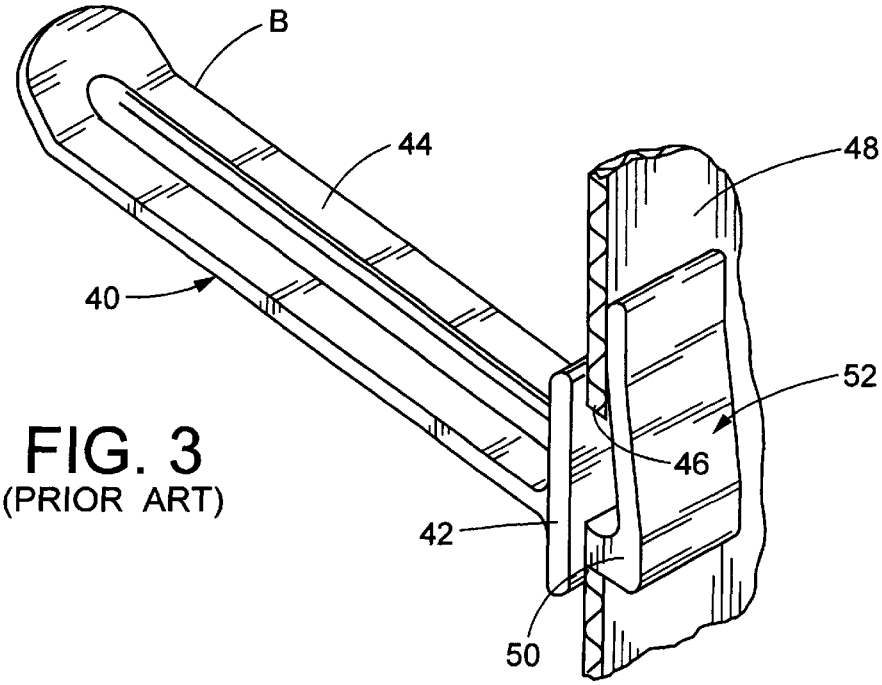
FIG. 3 (PRIOR ART)
FIG. 3 is a perspective view of the prior art display hook of FIG. 2 secured in a slot of a panel.

In order to remedy this situation, another display hook B, as illustrated in FIG. 2, was developed. This hook includes a hook body 40, a face plate 42 and a bar 44. This bar in contrast to the bar 18 illustrated in FIG. 1 is wide and has a so-called butterfly shape, as best seen in FIG. 3. The bar has an upturned front end to prevent packages from slipping off the bar when the hook is in position in a horizontally elongated aperture 46 of a display panel 48 as illustrated in FIG. 3. Extending rearwardly from the face plate is a bridge 50. In this embodiment, the bridge is only slightly narrower than is the width of the face plate 42 in order to strengthen the bridge. Extending upwardly from the bridge is a rear plate 52. As best seen in FIG. 2, the rear plate includes a first portion 54 which extends slightly toward the face plate 42 and a second portion 56 which lies in a plane parallel to the plane of the face plate 42. The second portion terminates in an upper edge which is located considerably above the upper edge of the face plate 42.

It has been found that the prior art display hook B is also prone to breakage when subjected to weights of more than about 3 or 4 lbs. The point of breakage for the display hook B is again the joint between the bridge 50 and the rear plate 52. It has been found that when more than 3 or 4 lbs. are suspended from the bar 44, the display hook body 40 will break at that joint.

The heavy duty display hook according to the present invention C is illustrated in FIG. 5. This display hook comprises a hook body 60 having a face plate 62. Extending from a front surface 64 (FIG. 4B) of the face plate is a support member or bar 66. Preferably, the bar extends forwardly and upwardly at a slight angle to a horizontal plane passing through the face plate. The bar 66 terminates in an upturned tip portion 68. Extending from the rear surface 70 of the face plate 62, are a pair of spaced L-shaped arms 72. The arms are mirror images of each other. Thus only one will be discussed, it being appreciated that the other arm has a mirror image construction.

Figure 4B:
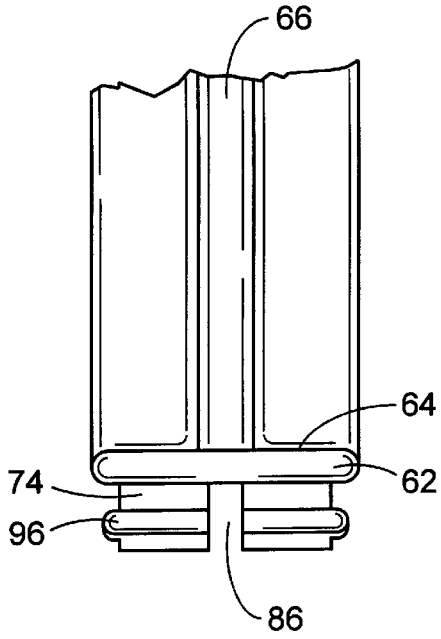
FIG. 4B is a top plan view of a rear section of the product display hook FIG. 4A.
Figure 4C:
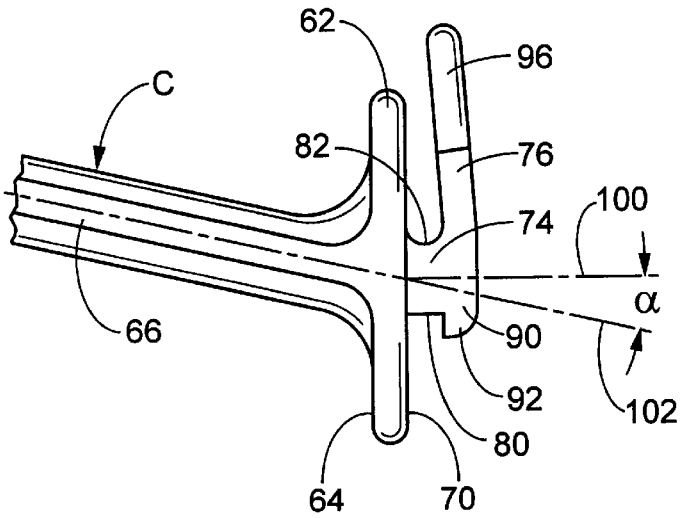
FIG. 4C is a side elevational view of a rear section of the product display hook of FIG. 4A.
Figure 4A:
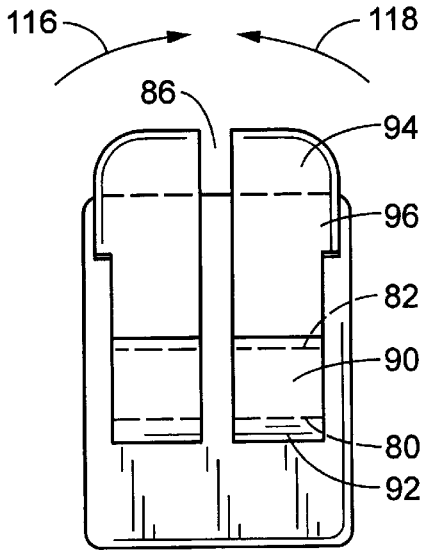
FIG. 4A is an end elevational view of a product display hook according to a first embodiment of the present invention from a rear end thereof.

The pair of spaced arms 72 each include a first section 74 and a second section 76 as illustrated in FIG. 4C. The first section includes a flat lower face 80 and a curved upper face 82 which is thicker when approaching the rear face 70 of the face plate 62 and a front face of the second section 76. As shown in FIG. 4B, a slot 86 separates the first and second arms 72 from each other. With reference again to FIG. 4C, the second section 76 includes a lower end 90 protruding from which is a flange 92. The second section also includes an upper end 94 from which extends a wing or ear 96. It is apparent from FIG. 4A that the wings 96 of the two arms 72 both extend away from the slot 86.

As shown in FIG. 4C, a longitudinal axis 100 of the first arm section 74 is located above a longitudinal axis 102 of the bar 66 by a distance a. The positioning of the arm first section axis above the bar axis reduces the moment force exerted on the joint between the arm 72 and the face plate 62 making the hook C less prone to breakage. This is in contrast with the prior art hook A illustrated in FIG. 1 and the prior art hook B illustrated in FIG. 2 wherein in each case a longitudinal axis of the respective bridge 20 and 50 is located below a longitudinal axis of the respective bar 18 and 44.

It is noted that the thickness of the arm second section 76 is equal to, and preferably slightly greater than, the thickness of the front plate 62. This is contrast with the relative thicknesses of the front and rear plates illustrated in the prior art hooks A and B shown in FIGS. 1 and 2 wherein, in each case, the rear plate is somewhat thinner than the front plate.

With reference now to FIG. 5, a panel 110 is provided with a series of regularly spaced, substantially rectangular apertures 112, one of which is illustrated. The pair of spaced arms 72 extend through a single aperture 112 when the hook C is in use. It should be appreciated that the pair of spaced arms 72 and the slot 86 between them, at the location of the wings 96, is wider than the aperture or hole 112. Therefore, in order to insert the arms into the hole 112, the arms need to be pushed towards each other, preferably at the upper ends 94, as is illustrated by arrows 116 and 118 in FIG. 4A. When this is done, the arms 72 can slide through the hole 112. Once on the back side of the panel 110, the arms will flex back to their original position due to the inherent resilience of the thermoplastic material from which the hook C is preferably made.

The panel 110 can be made out of a conventional cardboard material or from a suitable conventional type of plastic material. It has been found that the hook C has increased holding power as compared to the prior art display hooks A and B illustrated in FIGS. 1–3. At the same time, the amount of plastic material used for the arms is reduced, due to the presence of the slot 86, in comparison to the display hooks of FIGS. 1–3. The width of the slot 86 can be adjusted as may be desired for any particular application. To some extent, the width of the slot will depend on the type of material used for the hook A.

It should be appreciated that with the provision of the wings 96 on the second section 76 of the arm 72, the arms cannot be easily pulled out of the slot 112 because, as mentioned, the arms 72 and the slot 86 between them, are wider at the wings than is the width of the slot. In order to remove the arms 72 from the back side of the panel 110, the arms have to be flexed towards each other so as to allow the wings to clear the width of the aperture 112.

The flange 92 can also serve to prevent the display hook C from becoming detached from the panel 110 before any weight is put on the bar 66 by the packages suspended therefrom. More specifically, an upward force at the tip 68 of the bar 66 could serve to pivot the hook C in a clockwise manner about the panel 110. The flange 92 would prevent this. Of course, with the provision of the wings 96, it may not be necessary to also provide the flange 92.

Figure 6B:
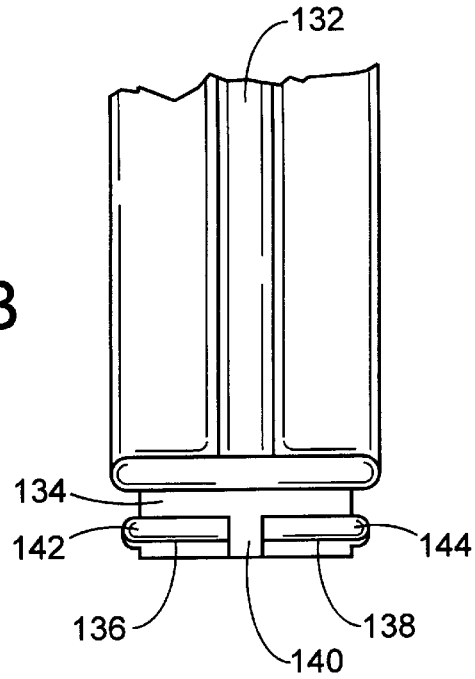
FIG. 6B is a top plan view of a rear section of the product display hook of FIG. 6A.
Figure 6C:
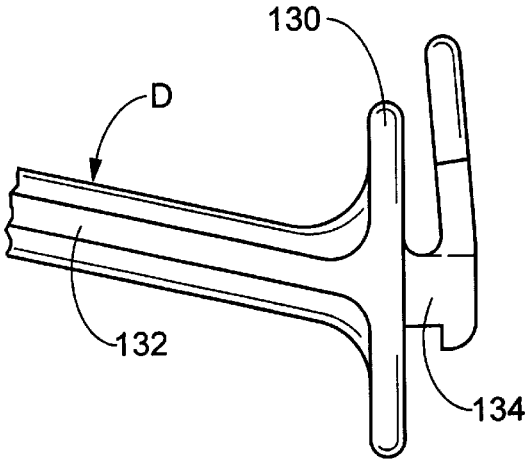
FIG. 6C is a side elevational view of a rear section of the product display hook of FIG. 6A.
Figure 6A:
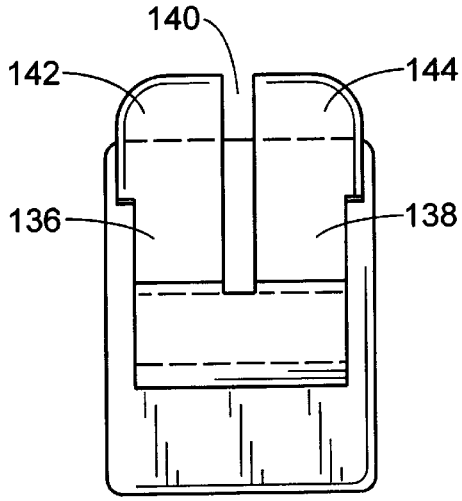
FIG. 6A is an end elevational view of a product display hook according to a second embodiment of the present invention from a rear end thereof.

With reference now to FIG. 6C, a second embodiment of the present invention is there illustrated. In this embodiment, a hook D includes a cover plate 130. Extending forwardly from the cover plate is a support member or bar 132. Extending rearwardly from the cover plate 130 is a base 134. Extending transversely away from the base 134 in approximately parallel and spaced relation to the cover plate 130 are a pair of spaced arms 136 and 138, as best shown in FIG. 6A. Located between the arms is a slot 140. Each of the arms includes an outwardly extending wing 142 and 144. The width of the two arms, including the wings, and the slot between them is wider than the width of the base 134 (see FIG. 6B) and of the aperture in the panel through which the arms 136 and 138 are meant to extend. Therefore, the arms need to be pushed towards each other in order to allow the arms to pass through the panel aperture. Thereafter, the arms, since they are made from a resilient material, will return to their original uncompressed state. At this point, the wings 142 and 144 will prevent the arms from being pulled back out of the aperture.

It should be appreciated that it would also be conceivable to provide a wing only on one of the two arms illustrated in FIGS. 4A–4C and 6A–6C, if so desired.

With reference now to FIG. 7, a hook E according to a third embodiment of the present invention is there illustrated. In this embodiment, the hook comprises a cover plate 160, protruding from a front surface 162 of which is a bar 164. Extending from a rear surface 166 of the cover plate are a pair of spaced arms 168 and 170. Each of these arms includes a first section 174 and a second section 176 as shown in FIG. 8. A space b separates the two arms 168 and 170. The arms are so spaced apart along the rear surface 166 of the cover plate 160 that they are capable of extending through a pair of spaced apertures 180 in a pegboard 182 in order to allow the hook B to be secured to the pegboard. It should be appreciated, however, that the hook E could also be secured in a single horizontally extending aperture in a cardboard panel such as the panels illustrated in FIGS. 3 and 5. Alternatively, the cardboard panel could simply have cut lines or score lines by which the cardboard panel could be bent out of the way by the arms 168 and 170. Such cut lines could, for example, be in the shape of an X, a T, a semi-circle, a crescent or the like.

With reference now to FIG. 8, it is noted that a longitudinal axis 190 of the first sections 174 of the pair of arms 168 and 170 is significantly above a longitudinal axis 192 of the bar 164. The gap is identified by the letter c. The positioning of the arm first section axis above the bar axis reduces the moment force exerted on the joint between the arm first section 174 and the arm second section 176 making the hook E less prone to breakage. This is in contrast to the prior art hooks A and B illustrated in FIGS. 1–3.

Figure 9B:
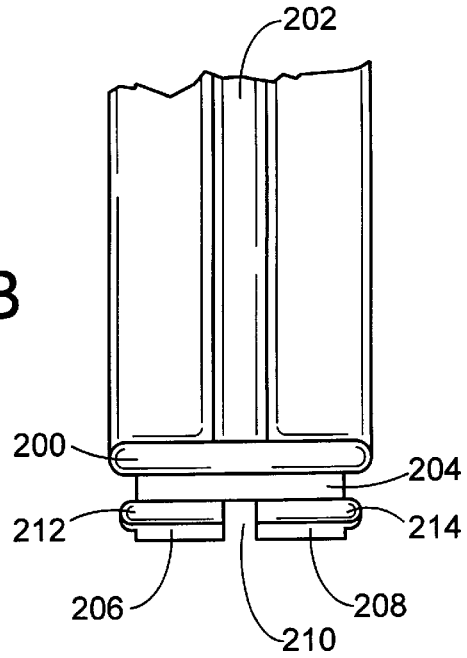
FIG. 9B is a top plan view of a rear section of the product display hook of FIG. 9A.
Figure 9C:
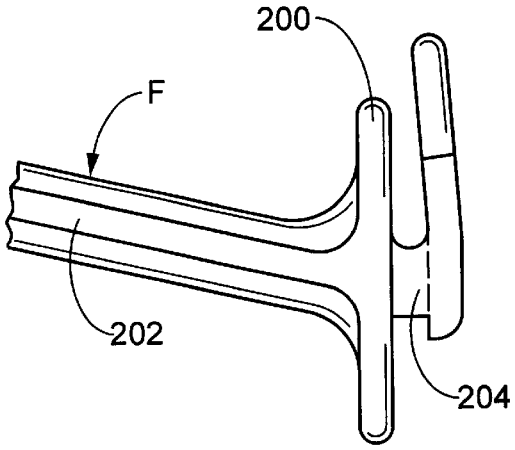
FIG. 9C is a side elevational view of a rear section of the product display hook of FIG. 9A; and, FIG. 10 is a front elevational view of a support wall showing a pair of cut lines in the shape of an "X".
Figure 9A:
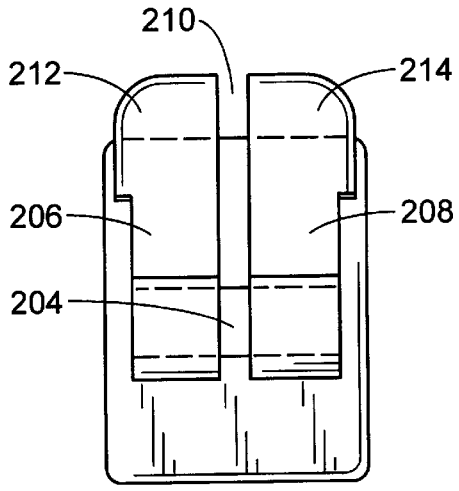
FIG. 9A is an end elevational view of a product display hook according to a fourth embodiment of the present invention from a rear end thereof.
Figure 10:
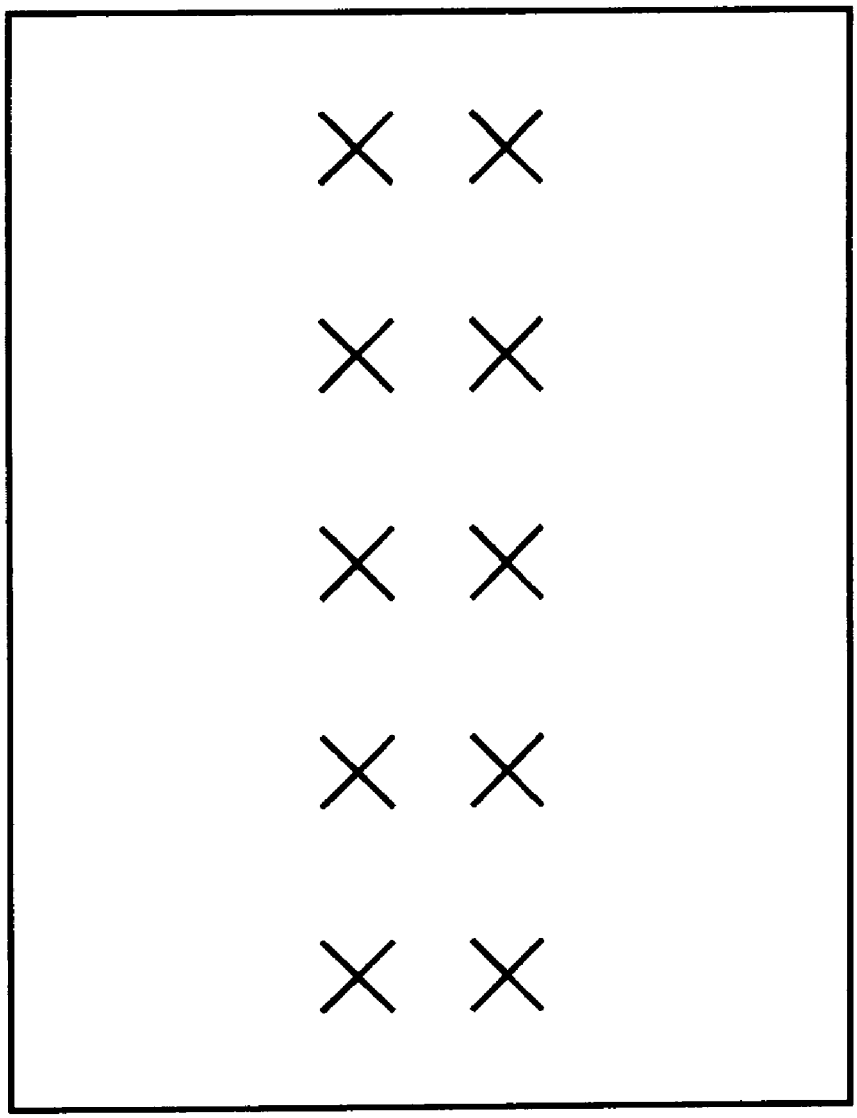

With reference now to FIG. 9C, a fourth embodiment of the present invention is there illustrated. In this embodiment, a hook F includes a cover plate 200. Extending forwardly from the cover plate is a support member or bar 202. Extending rearwardly from the cover plate is a bridge 204. Extending transversely to the bridge from a rear edge thereof, and approximately parallel to the cover plate 200, are a pair of spaced arms 206 and 208, as best shown in FIG. 9A. Located between the arms is a slot 210. Each of the arms includes an outwardly extending wing 212 and 214. The width of the two arms, including the wings, and the slot 210 between them, is wider than the width of the bridge 204 (see FIG. 9B) and of the aperture in the panel through which the arms 206 and 208 are meant to extend. Therefore, the arms need to be pushed towards each other in order to allow the arms to pass through the panel aperture. Due to the resilient nature of the material from which the hook F is preferably made, the arms are capable of flexing so as to allow themselves to be pushed towards each other. Thereafter, the arms, since the resilient material has a memory, will return to their original uncompressed state. At this point, the wings 212, 214 will prevent the arms from being pulled back out of the aperture in the panel.

The invention has been described with reference to several preferred embodiments. Obviously, modifications and alterations will occur to others upon a reading and understanding of this specification. It is intended to include all such modifications and alterations insofar as they come within the scope of the appended claims or the equivalents thereof.

What is claimed is:

1. A display hook for insertion into a pair of spaced apertures of a panel, comprising:

a front plate which is substantially vertically disposed in use and which has an upper end and a lower end;

a forwardly projecting support member extending upwardly in slightly inclined fashion from said front plate, wherein said support member has a longitudinal axis;

a first L-shaped arm extending rearwardly from said front plate, said first L-shaped arm having a first section extending rearwardly from and approximately normal to said front plate below said upper end thereof and a second section extending approximately normal to said first section and approximately parallel to said front plate;

a second L-shaped arm extending rearwardly from said front plate, said second L-shaped arm having a first section extending rearwardly from and approximately normal to said front plate below said upper end thereof and a second section extending approximately normal to said first section and approximately parallel to said front plate;

wherein said first sections of said first and second arms each have a longitudinal axis which is located above said longitudinal axis of said support member; and wherein said front plate includes an upper portion located above said forwardly projecting support member whereby said display hook resists removal from the panel when an upward force is exerted on the support member.

2. The hook of claim 1 wherein said first sections of said first and second L-shaped arms are located above said lower end of said front plate.

3. The hook of claim 1 wherein said front plate, said forwardly projecting support member and said first and second L-shaped arms are of one piece and are made of a plastic material.

4. The hook of claim 1 wherein said first sections of said first and second L-shaped arms are each thicker than a thickness of said front plate.

5. A one piece display hook for a retail product display system having at least one pair of spaced hook receiving apertures in a wall thereof, comprising:

a front plate which is substantially vertically disposed in use and which has an upper end and a lower end;

a forwardly projecting support member extending upwardly in slightly inclined fashion from said front plate;

a first L-shaped arm extending rearwardly from said front plate, said first L-shaped arm having a first section extending rearwardly from and approximately normal to said front plate and a second section extending approximately normal to said first section and approximately parallel to said front plate;

a second L-shaped arm spaced from said first L-shaped arm and extending rearwardly from said front plate, wherein said second arm includes a first section extending rearwardly from and approximately normal to said front plate and a second section extending approximately normal to said first section and approximately parallel to said front plate; and wherein said first sections of said first and second arms are positioned below an upper portion of said front plate so that the display hook resists removal from the display system wall when an upward force is exerted on the support member.

6. The hook of claim 5 wherein said front plate, said support member and said first and second arms are made of a plastic material.

7. The hook of claim 5 wherein said forwardly projecting support member is located between said upper and lower ends of said front plate.

8. A product display system comprising:

a support wall made of at least one sheet of flat, thin planar material having at least one generally vertical planar forward facing side, said vertical side having at least two spaced mounting apertures extending therethrough; and, a one piece display hook for insertion into a pair of said at least two spaced mounting apertures, said display hook comprising:

a front plate which is substantially vertically disposed when secured to said support wall and which has an upper end, a lower end, a forwardly projecting support member extending upwardly in slightly inclined fashion from a first face of said front plate, a first L-shaped arm extending rearwardly from a second face of said front plate, said first L-shaped arm having a first section extending rearwardly from and approximately normal to said front plate below said upper end thereof and, a second section extending approximately normal to said first section and approximately parallel to said front plate, a second L-shaped arm extending rearwardly from said front plate, said second L-shaped arm having a first section extending rearwardly from and approximately normal to said front plate below said upper end thereof and, a second section extending approximately normal to said first section and approximately parallel to said front plate, and wherein said first sections of said first and second arms extend through respective ones of said at least two spaced mounting apertures of said vertical side of said support wall when said display hook is secured to said support wall wherein said first sections of said first and second arms are located below an upper portion of said front plate so as to retard a removal of said display hook from said support wall when an upward force is exerted on the support member.

9. The display system of claim 8 wherein said first sections of said first and second L-shaped arms are located above said lower end of said front plate.

10. The display system of claim 8 wherein said second sections of said first and second L-shaped arms are positioned behind said support wall when said display hook is secured to said support wall.

11. The display system of claim 8 wherein said first sections of said first and second L-shaped arms are each thicker than a thickness of said front plate.

12. The display system of claim 8 wherein said pair of mounting apertures each include substantially circular apertures.

13. The display system of claim 8 wherein each of said pair of apertures is formed by cut lines extending through said at least one forward facing side.

14. The display system of claim 13 wherein each of said pair of apertures comprises a pair of cut lines formed in the shape of an X.

* * * * *